United States Patent [19]

Burlingame

[11] Patent Number: 4,584,855

[45] Date of Patent: Apr. 29, 1986

[54] PICK-PROOF LOCKING SYSTEM

[76] Inventor: Glen Burlingame, 2858 W. 55th St., Chicago, Ill. 60632

[21] Appl. No.: 508,740

[22] Filed: Jun. 29, 1983

[51] Int. Cl.[4] ..... E05B 67/04

[52] U.S. Cl. ..... 70/38 A; 70/39; 70/423; 70/455

[58] Field of Search ..... 70/38 R, 38 A, 38 B, 70/38 C, 39, DIG. 20, DIG. 27, 423, 455, 54–56

[56] References Cited

U.S. PATENT DOCUMENTS

| | | | |
|---|---|---|---|
| 1,222,545 | 4/1917 | Gross | 70/38 C |
| 1,334,292 | 3/1920 | Cox | 70/DIG. 20 |
| 2,834,195 | 5/1958 | Stackhouse | 70/38 B |
| 3,267,707 | 8/1966 | Adams | 70/419 |
| 3,621,688 | 11/1971 | Asmar et al. | 70/358 X |
| 3,680,337 | 8/1972 | Krakauer | 70/419 |
| 3,714,804 | 2/1973 | French | 70/419 |
| 3,765,199 | 10/1973 | Wiczer | 70/423 |
| 3,855,826 | 12/1974 | Hori | 70/38 A |
| 4,085,600 | 4/1978 | Bindari | 70/39 |

*Primary Examiner*—Kenneth J. Dorner
*Assistant Examiner*—Lloyd A. Gall

[57] ABSTRACT

A pick-proof u-bolt type lock is disclosed with an untypical location for containing its cylinder lock. A tube, comprising a housing, has openings near its ends that accept the ends of a shackle which are secured within that housing. A cylinder lock is located between the shackle openings and an access port is provided to it for insertion and withdrawal of the key. A matching port on a collar that rotates around the housing is positioned to shut off that access, or to allow it selectively.

Cooperating parts attached to, and effecting the operation of the lock, work to make the lock inoperable while access to the keyhole is available; and allow normal function of the lock when rotation of the collar prevents access. The key is not turned by finger grip, but instead, affecting the closure, turns the key and plug operating the cylinder lock and releasing the shackle at one end. The remaining end is freed as it swings clear of a securing pin in the other end of the housing.

An enclosed operating key may continue to remain attached to an outside device, such as a key ring, a narrow slot through which the connection may pass is provided on the perimeter of the access port.

5 Claims, 15 Drawing Figures

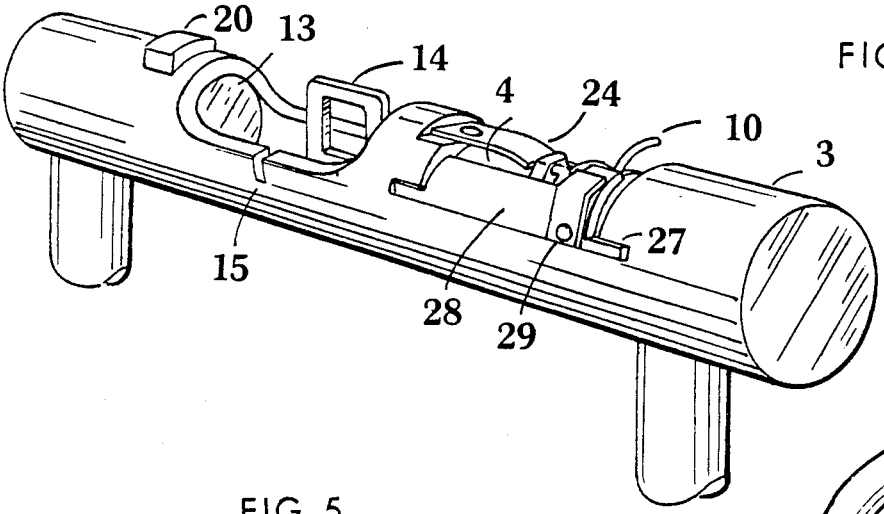
FIG. 4
FIG. 5
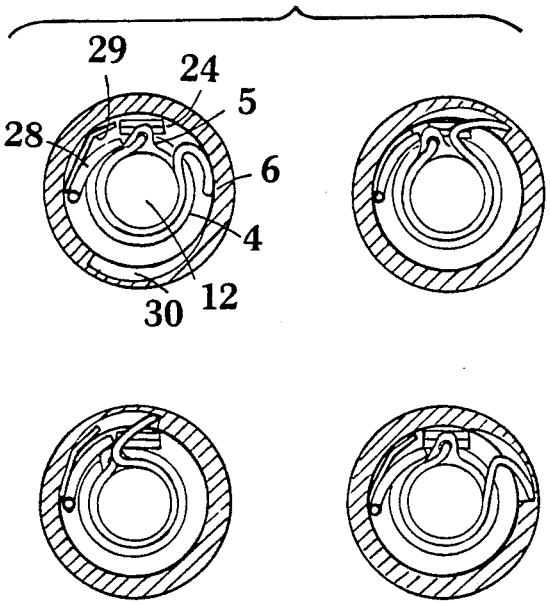
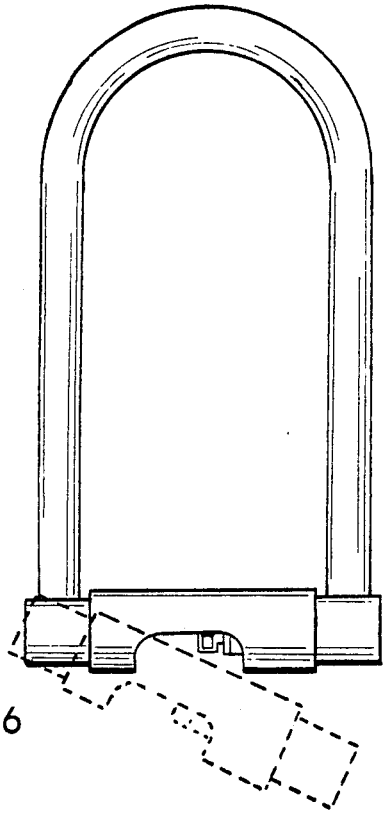
FIG. 6
FIG. 7
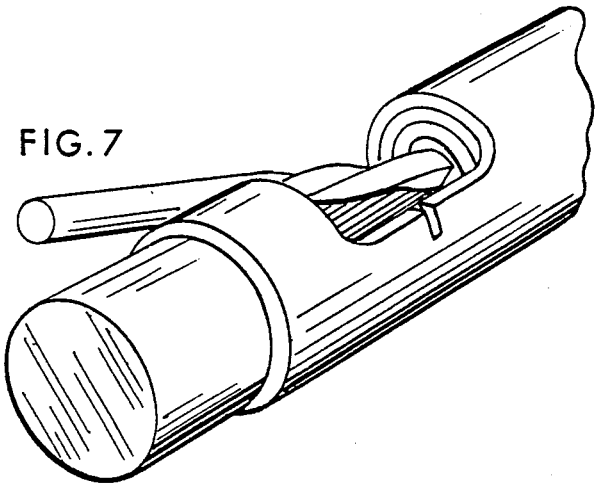
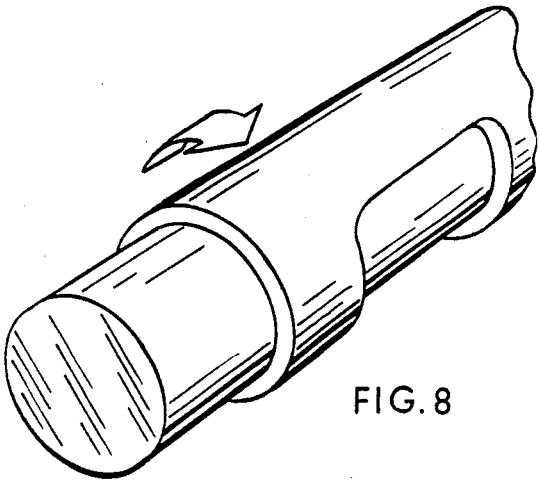
FIG. 8

FIG.9
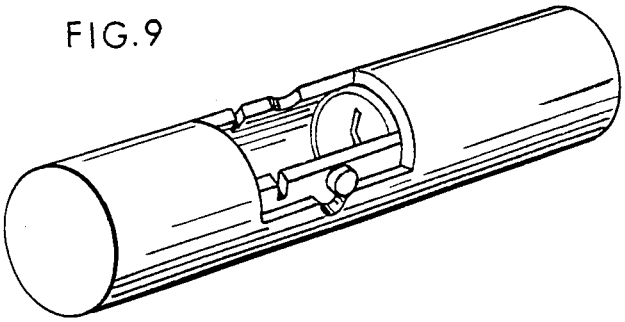
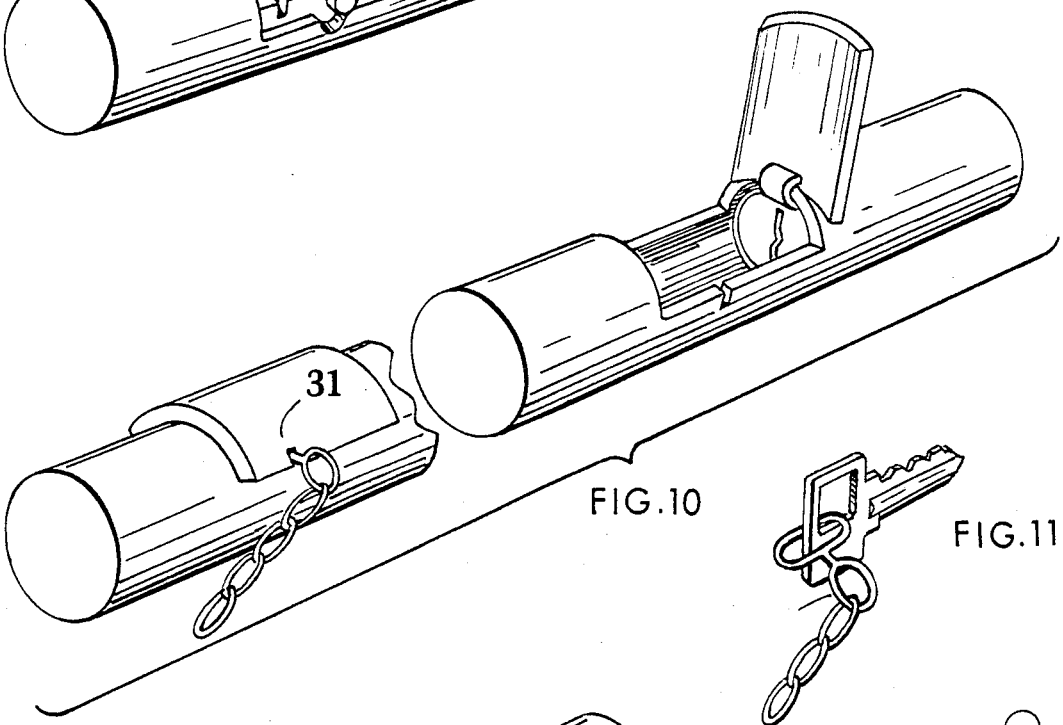
FIG.10
FIG.11
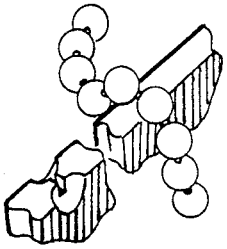
FIG.12
FIG.13
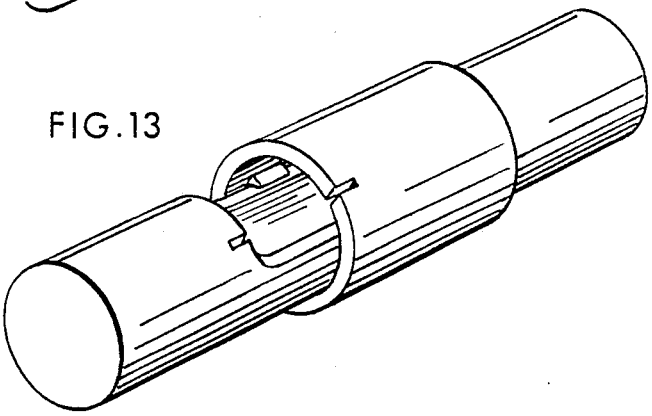
FIG.14
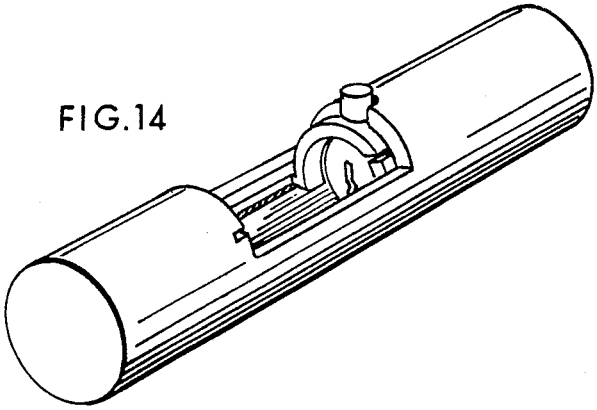
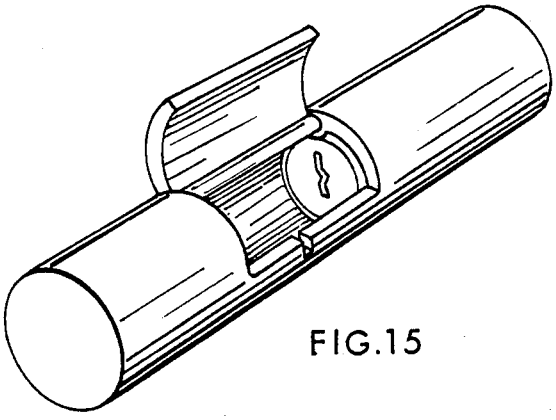
FIG.15

PICK-PROOF LOCKING SYSTEM

BACKGROUND OF THE INVENTION

This invention relates generally to locking devices and, more particularly, to an anti-pick enclosure for a lock having a key slot.

The widely used cylinder lock has several variations of mechanisms that respond to a key in a rotatable portion called a plug within the cylindrical housing.

Of these variations—the pin tumbler and variations of this principle are the most secure locks generally. But another large class of cylinder locks use discs in place of pins.

Nevertheless both general types can be readily compromised with picking techniques, and even the complex improvements of these locks have been opened with special techniques and key substitutes.

Tubular forms of the pin tumbler lock are not significantly superior to the standard type, and are pickable by special tools whose sale from locksmith supply companies cannot be, and are not, successfully limited to authorized locksmiths. Flat key picking devices are similarly not restricted.

Altogether the techniques for picking locks have been well known for some time, and even expensive locks designed to be pick-proof are not. The locks in common use and improvements on these now on the market are not truly secure because the means of picking these locks is still existant. Namely, access to the keyhole and the interior of the lock and its mechanism from outside the lock with minimal interferance to movement and penetration.

The prior art contains examples of various ways of obscuring, covering, and interferring with this free access to the keyway. Examples are French U.S. Pat. No. 3,714,804; Wiczer U.S. Pat. No. 3,765,199 and Adams U.S. Pat. No. 3,267,707. Additionally, Krakauer covers the keyway in U.S. Pat. No. 3,680,337.

Without exception, these examples and all prior art I've been able to discover in this area, either alters the standard key shape, alters the standard pin tumbler lock used as a basis for the improvement, (incidently, the pin tumbler lock as used to the exclusion of other cylinder types of locks entirely) or leaves a restricted but penetratable key slot through which special picking means can be effectively inserted and manipulated.

When a key shape is altered, the user is inconvenienced and charged more for duplicate keys. Keys must be ordered from the factory for replacement or duplication, with the attendant delay and added expense.

When a standard lock is altered, this adds tooling costs to the price of the lock during its amortization period. Depending on the extent of the alteration, it is less competitive in the mass market as a result of such special design requirements.

When *any* access is left to the lock mechanism internally, it compromises the security of the lock. Such access may slow the process of picking and make it more difficult, but does not prevent it altogether.

All the examples I've been able to locate in prior art make use of a lock with a particularly small range of rotational movement of the plug. As mentioned earlier, this is the pin tumbler type. Tolerances are very small between pins and bores in which the pins operate, so that small amounts of wear on the obscuring means, or covering means, that prevent rotation of the plug until the enclosed mode is attained, over the lifetime of use of the lock, can lead to pressure contact between pins and bores, even when torque is applied in the open protected mode.

This contact becomes the means by which the lock is picked, since the pins can be held in place as they are experimentally lifted to the shear line between the outside of the plug, and the inside of the bore in the cylinder or housing that receives the plug.

In this procedure, the pins are experimentally manipulated to the shear line individually, held there by the pressure possible to exert on them from one side of the bore in the plug, and the opposite side of the bore, holding the same pin, in the cylinder.

When thus arranged and held in positions at the shear line, the closure, whatever its nature, can be moved to the position where it releases the plug to rotate, and as long as some means of exerting a slight torque on the plug is possible, a special key substitute with a spring urging it to rotate is one possibility, the lock can be opened, even within an enclosure.

An object of the present invention is to produce torque on the plug in a cylinder lock in the opposite direction to key rotation, so that pins cannot be held in position at the shear line when individually lifted to the shear line experimentally, without being released as the plug is rotated in the direction that opens the lock. This nullifies the effect that wearing parts that occur during use of the lock, over a period of time, have on the security of such a lock.

A further object is to make use of a standard key that can be duplicated conveniently and economically at hardware stores annd locksmith shops, etc.

A further object of my invention is to make use of a standard pin tumbler, or disc lock, but not limited to these types, in an assembly that will make it invulnerable to picking, without altering the lock if that is desirable. Avoiding alteration of the lock is optional, of course.

A further object of my invention is to prevent drilling out of the lock, when it is used in one optional application, that of a padlock or u-bolt type lock, now being widely used. When used in this application it is placed between the shackle ends, shortening the body or housing of the lock, and requiring any drill bit to enter the soft parts of the lock, housed in a hardened case, at such an angle that the critical securing means behind the standard lock cannot be reached to destroy them, to release the lock.

Another object of my invention is to make the operation of an enclosed lock require a minimum of effort on the part of the user. All the patents cited previously as examples of partially or wholly enclosed key ways protecting locks related and attached to these provisions, require a motion to obscure the keyway, and a second or third motion to operate the lock and made the key accessible for removal again. As an additional convenience, my locking system can be locked without the use of a key by simply pushing against the face of the lock containing the key way, thus moving the lock into its locking mode.

For convenience it is desirable that the user of the lock can elect to keep the lock's key attached, to means of carrying that key. A key chain, ring, or other device can remain attached to the key which is fully enclosed during operation of the lock, without compromising its security.

A small slot in the edge of the enclosure allows no access for picks, but provides this added advantage over other locks that fully enclose the key, or parts of the key.

Other objects are invulnerability to forceful opening, compactness, and protection of the locks mechanism against the enviroment.

Placing the cylinder lock in a position in the housing between the shackle ends, rather than in an extension outside of one end, has other advantages.

Used as a lock for securing two-wheeled vehicles, its short housing makes it more compact for carrying.

It is less subject, in its most common application, that of fastening a vehicle to a fixed object; to damage from blows by a tool.

All other u-bolt type locks of this configuration have an extension holding the cylinder lock beyond one shackle insertion position in the housing.

This extension is commonly from 1½" to 2" long, and since the center of the housing lies next to the vehicle, or fixed object, and cannot be struck direct blows, the protruding end becomes the vulnerable area to apply effective force. The ends of the housing in my embodiment that lie outside the shackle insertions are minimal, and allow only ineffective glancing blows to be struck at them.

That this means of attacking a u-bolt type lock is acknowledged, is demonstrated by U.S. Pat. No. 4,085,600, granted to Bindari, in which the inventor places an offset in one shackle end, specifically to overhang and protect the extended part of the lock housing from direct blows. This design has found its way into at least two makes of u-bolt locks, now on the market.

Cylinder locks are sometimes forcefully pulled from their locations in a housing by turning a hardened sheet metal screw through the keyslot into the soft brass or diecast parts of the locks mechanism. Then a pounding force is produced by a weight sliding on a rod attached to the screw and having a stop at the other end of the rod.

As the weight is moved rapidly to the end of the slide rod, the stop transfers the kinetic energy in the weight to the rod, which pulls aginst the sheet metal screw. This produces considerable force to dislodge the lock from its seat.

The tool that is applied to this effort is a common one used in auto body and fender work to pull out dents in sheet metal; so it is readily available. The tool cannot be applied as effectively, if at all, when the cylinder lock does not have easy access for forcing the screw into the lock, nor a straight line path for withdrawing it.

Lastly, the enclosure of the cylinder lock, and especially its keyhole during use, protects it against water (from rain and snow) and grit, in the form of airborn particles.

Some padlocks achieve this advantage with the use of a separate enclosing protective plastic jacket with a hinged access port to the keyhole. Others incorporate a keyhole cover in the lock body itself.

The fact, that despite added cost, these features are popular attests to the desirability of protecting the lock mechanism against contaminents.

DESCRIPTION OF DRAWINGS

FIG. 4. A perspective of the lock body and its contained mechanism as it would appear with the collar removed, that normally encircles its center section.

FIG. 5. Four drawings representing cross sections of the lock through the area containing the cylinder lock and its cooperating parts, showing a sequence of actions during locking and unlocking.

FIG. 6. The preferred embodiment, a u-bolt type padlock, illustrating with a dotted line, how the housing, when released from one shackle end, by unlocking with a key, swings around the other shackle end, in the action that will disengage it from its remaining end and free it entirely from the shackle.

FIG. 7. A view illustrating the angle a drill bit is forced to take, in attempts to drill out the cylinder lock within the housing.

FIG. 8. A view of the housing in a closed mode, cutting off access to the cylinder lock and its keyway.

Figures 1, 2, 3:
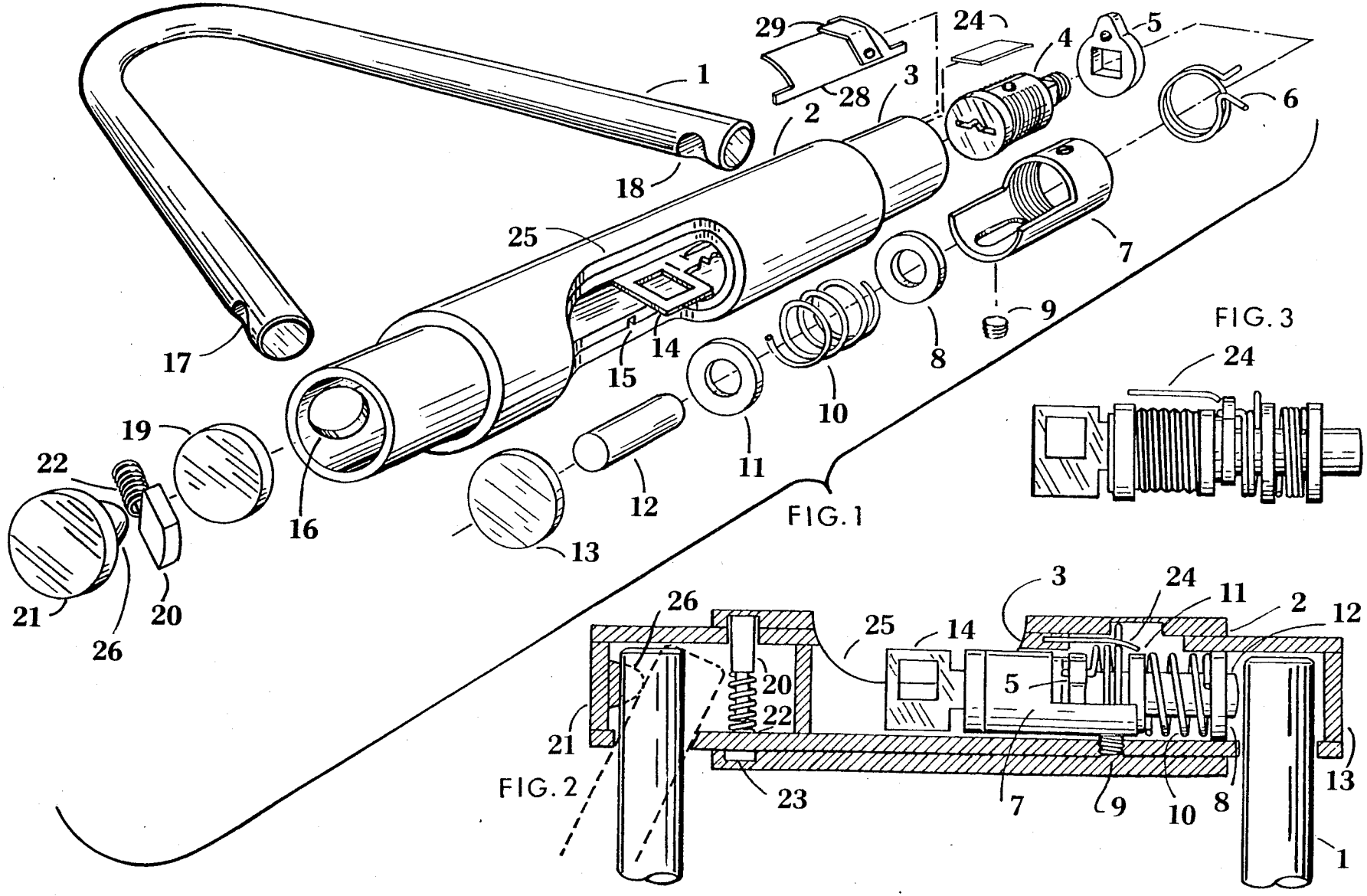
FIG. 1. Is an exploded view of the preferred embodiment of my enclosed lock principle, showing the parts that comprise the housing and and mechanism for making the cylinder unpickable.
FIG. 2. A cross section of the assembled u-bolt lock in which the internal parts and shackle are shown in their proper positions in the unlocked mode. A dotted line indicates the position of one shackle end as the shackle is disengaged prior to removing from the housing or body into which it is secured in the locked mode.
FIG. 3. The sub-assembly shown in its locking mode with the spring that withdraws the shackle pin from a hole in the shackle end, shown compressed, and the whole assembly held in position against the coil spring's tension by a flat spring engaged on the top of the unit to a projection.

The next FIGS. 9 through 15 prepresent alternate enclosure means to protect the lock against picking in a u-bolt type lock embodiment, with the exception of FIGS. 11 and 12. These two detail means for allowing the key's attachment to an outside key chain, ring, or similar device.

FIG. 9. An alternate enclosure method that slides within the body.

FIG. 10. An alternate enclosure method that is pivoted at one end.

FIG. 11. Shows one of several means of attaching a key with a special link that runs through a slot in the edge of the access cutout, to an outside attachment.

FIG. 12. Shows a special slot in the body wall which accepts part of a bead chain, without interferring with the closure action, enabling a key to remain attached to something outside.

FIG. 13. An alternate enclosure method which slides along the length of the body, to expose, or cover access to the key and lock.

FIG. 14. An alternate enclosure method that slides within the body.

FIG. 15. An alternate enclosure method which hinges on the outside.

DESCRIPTION OF OPERATION

Referring to the various figures, a description of the construction and operation of my invention follows.

It is determined by my selected embodiment, but not limited to it.

A standard lock, pin tumbler, disc, or other variety referred to as a cam lock is pictured in the drawings. For the purposes of compactness and economy, this modified form of the cylinder type lock was chosen.

The lock and its co-operating parts are mounted within a housing or body of tubular shape, as shown in FIGS. 1, 2 and 4, number 3.

This housing has an aperture 25 through which the key slot in the lock 4 shown in FIGS. 1, 2 and 3 is accessible for insertion and removal of a standard key 14.

The housing 3, has surrounding it in its center section, a collar 2 with a similarly shaped access aperture 25, shown in FIGS. 1, 2, 6, 7 and 8.

When this rotatable collar is so positioned that the two access apertures coincide, the appearance is as shown in FIGS. 1 and 7. When this aperture, or port, is closed during the operation that will release the shackle, it appears as FIG. 8.

A large shackle shaped like the letter 'U' is shown in this preferred embodiment, represented in its entirety by number 1, in FIG. 1 and FIG. 6, partially in FIGS. 2 and 4. This shackle has two holes near its ends, shown on FIG. 1, numbers 17 and 18.

In the locked mode, the ends of the shackle are secured in the body as two pins penetrate the holes; FIG. 2 shows penetration of one and withdrawal from the other.

An annular groove cut into the inside wall of the collar 2 is numbered 23 in FIG. 2.

A retaining pin 20 is inserted into this groove and holds the collar in place as a compression spring 22 keeps it in this groove.

In FIG. 1 a lock carriage 7 supports lock 4 in a slidable manner. A slot in the carriage 7 receives a set screw 9, or a boss in the body.

A retainer latch lies over the rear section of the lock 4 shown in FIGS. 1 and 4. It is in contact with latch pin 5 mounted on the end of the lock plug. In its position in FIG. 4 it prevents rotation of the plug.

The shackle locking pin 12 penetrates and is guided by the pin guide 8 as shown in FIGS. 1, 2 and 3.

Inside the collar 2 is a cavity 30, shown in 4 cross sections, FIG. 5. A flat spring 29 formed with a slight bend is mounted as exploded view shows in FIG. 1. This spring ordinarily remains compressed between the retainer latch 28 to which it is attached, and the inside surface of the collar which covers it. It is released, FIG. 5, when the cavity 30 is in position above retaining latch 28. In this position it may move to clear the latch pin.

The tube 3 that constitutes a housing for the lock assembly is closed at both ends by end caps 13 and 21 in FIGS. 1 and 2. Incorporated in the tube is a baffle 19, also shown in FIGS. 1 and 2. It closes off the opening in the body 3 at the end of the access aperture 25. The other end of the aperture is closed off by the lock assembly inserted into the tube, called the body, or housing.

A flat spring 24 is mounted to the body contacting a pin and disc combined, called a latch pin, containing a square hole located in the center 5, shown in FIGS. 1, 2, 3, 4 and the sequence of operations in FIG. 5.

A coil spring 10 is mounted by its end projecting through a hole in the latch pin, a combined disc and pin 5. This spring surrounds a shackle pin 12, shown in FIGS. 1, 2 and 3. The shackle pin has an internal thread, and is screwed to the threaded projection typically existent on the ends of cam locks—see exploded view FIG. 1, number 4. To complete the assembly, the shackle pin 12 runs through the washer 8, and a compression spring 10.

The assembly described, is contained within an altered tube, the lock carriage 7. It is threaded internally and the lock 4, which is provided with threads typically, is screwed into this carriage. A drive pin or set screw through matching holes in the top of the lock and carriage prevent unscrewing.

The retaining latch 28 is a curved flap with pivots 27 which fit into recesses in the body, shown in FIG. 4.

Finally, a cavity is machined into the collar over the area of the coil spring 10 when collar 2 is mounted normally in its position over the body.

This can best be seen in FIG. 5 in 4 drawings, all cross sections through the area where this cavity is existent.

Finally, there are a number of alternate ways of covering a hole for access to the key slot in a tube used as a housing for a lock assembly. I've only described one and its cooperating parts in my preferred embodiment. Each one would require its own arrangements of parts to effect the same actions on the lock assembly, but all employ the principle of enclosing the lock and key and preventing operation of the lock while there is access to its keyway.

Several of these are illustrated in FIGS. 9, 10, 13 and 15. I include them in this application, because a choice between them is based on economic considerations, principally tooling costs, and therefore at this patent stage, they are all viable alternatives to my chosen embodiment.

An additional convenience feature is shown in FIGS. 1, 2, 4 and 7, which maintains the security of the lock, but allows the user to retain his or her key on a keychain or ring arrangement while operating the lock with the key fully enclosed. The slots are drawn larger in the figures, for clarity, than they need be in practice.

The slots also can be slanted at an angle, instead of penetrating the tube's interior at 90°.

In FIG. 11 a special connecting link 31 is shown. In FIG. 10 it passes through body wall in slot 15, but allows movement of key, as does the bead chain passing through a special slot in FIG. 12.

If we begin a description in the locked mode, then the u-bolt shackle 1 is secured in the lock body, or housing 3, by passing through two holes, one of which is shown in FIG. 1 as 16, and being held in the body by pin 12 projecting into the hole in the shackle end designated 18, while the other end of the shackle is secured by the domelike pin 26 projecting into the hole 18 in that end.

We'll assume the user has rotated the collar 2 so as to cover the access port, or aperture 25, in the body for protection against rain. The user returns to unlock the u-bolt lock and goes through this sequence: (this rotation is viewed from the face of the cam lock, as a user would view it).

The collar is rotated counterclockwise until the access port is open. The key is inserted through the key slot into lock 4. The collar is then rotated clockwise again until the access port is entirely closed. Now because the following actions are more clearly understood by viewing them from the rear of the cylinder lock where they occur, it will be understood that the orientation is changed from front to rear.

Referring to the cross section drawings in FIG. 5, proceed from the top left to right, then the bottom left to right.

In the first cross section, the u-bolt lock is locked, the access port is fully open. The retainer latch 28 is pressed hard against the latch pin 5 by the flat spring 29 fixed to the retainer latch, and compressed between it and the inside wall of the collar. The coil spring 6 also is distorted as its projecting end is bent by its confinement against the same inside surface of the collar. It will be noted that the torque expressed on the plug is the opposite to that which would be produced by a key operating the lock, or picks attempting to. The retainer latch, pushing against the latch pin, attached to the plug, holds this position of the plug securely against turning in a counter clockwise direction, and this prevents binding of the pins or wafers in the lock. Without this binding action, a requirement for picking this lock is eliminated.

The second cross section represents the beginning of the sequence of events necessary to open the lock.

The user now rotates the collar in a counter clockwise direction, closing the access port partially. The hooked end of the coil spring 6 catches in the abrupt flat portion of the cavity 30 machined into the inner surface of collar 2. The spring is wound around the shackle pin 12 while its other end is held by an offset projecting through a hole in the latch pin 5.

This produces a torque on the plug to which the latch pin is secured. A square hole in the latch pin fits over the typical square shaft at the end of the plug, preventing relative rotation between the two.

Refer to the third cross section. As the collar is further rotated, the outside surface of the hook on the spring 6 comes in contact with the underside of projection on the retaining latch 28.

This part of the spring acts as a wedge, lifting the retaining latch 28 to clear the protruding portion of the latch pin 5. The flat spring 29, previously under tension, moves up into the cavity 30, now proximate to it, lessening the force it expressed on the retaining latch 28.

The plug is now free to rotate within the lock 4 if the correct key is in place, moving pins or discs or other parts within the lock to their correct positions. The access port is now fully closed.

Continuing; the coil spring 10 rotates the plug as it lifts the restraint to such movement, the restraining latch 28 swings on two pivots 27, riding over the latch pin.

As the plug rotates, the projection on the latch pin 5 moves out of contact with the end of a spring 24 and is no longer restrained from being pushed back toward the opposite end of the body by the compression spring 10, around the shackle pin 12. The entire assembly, the carriage, cylinder lock and shackle pin move with the latch pin, resulting in the shackle pin 12 being withdrawn from the hole 18 in the shackle end. This unlocks one end of the shackle. The shackle is then tilted to clear the fixed pin in the opposite end of the housing and withdrawn.

Lastly, refer to the fourth cross section. This represents the beginning of another cycle. The lock has been opened, the user has turned the key as far as it will go, has removed it, and is closing the access port. It could also represent the next rotation of the collar, counter clockwise, to open the lock. As the end of the coil spring 10 first engages the abrupt end of the cavity 30, but is still without tension, due to its winding, it should be noted that the coil spring 10 is a means of producing lost motion. When there is no key in the lock (or the incorrect key), it will be seen that if the plug does not turn in response to the torque from this spring, the collar can still be rotated to a position where it protects the lock, because of this non-ridgid connection between collar and latch pin.

The procedure for locking the u-bolt is essentially reversing the actions described. The cylinder lock can be pushed inward without the use of its key after the shackle has been re-inserted into the body. This causes the shackle pin to engage one end of the shackle, the other shackle end was engaged by tilting the shackle and inserting it into the appropriate opening in the body, or housing, where a fixed pin engages it. The shackle pin is kept in this position despite a compressed coil spring, number 10, urging it back again. The flat spring 24 prevents the latch pin and its assembly, including the shackle pin, from retreating.

While the preceding description contains many specifics, these should not be construed as limitations on the scope of the invention.

Rather, they are exemplifications of only one embodiment, thereof, plus variations optionally available for closure methods.

What is claimed is:

1. A pick-proof lock assembly comprising:

a shackle having two legs;

a tubular collar having a central aperture;

a tubular housing having a central access aperture therein and further having lateral apertures for receiving the legs of said shackle;

said collar being rotatably mounted around said housing between a first position preventing access to said housing aperture and a second position wherein said collar aperture and said housing aperture are aligned;

a key;

a support means mounted in the housing;

a lock cylinder mounted on the support means, said lock cylinder having a first end including a key slot and a second end including an axial extension, said first end being accessible only through said housing access aperture;

a latch pin supported by said lock cylinder;

a shackle lock pin mechanically connected to said latch pin, said shackle lock pin being received in one leg of said shackle in a locked position and being retracted from said shackle in the unlocked position;

a spring biased retainer latch associated with the second end of said lock cylinder, pivoted in the housing and adapted to secure said shackle lock pin in locked position, while forcing said lock cylinder to rotate and be held in an extreme limit of rotation opposite the direction necessary to open the lock;

whereby upon insertion of said key into said key slot and upon rotational movement of said collar from said second position to said first position, said shackle lock pin moves from said locked position to said unlocked position, freeing said shackle for removal from said housing.

2. The lock assembly of claim 1 wherein said support means is adapted to slide in the axial direction within said housing between locked and unlocked positions, and a restoring spring is provided which returns said support means from the locked to unlocked position.

3. The lock assembly of claim 2 wherein said assembly is caused to be locked by pushing upon the first end of said lock cylinder, causing sliding movement of said support means with consequent engagement of one leg of said shackle by said shackle lock pin.

4. The lock assembly in claim 3 wherein a fixed pin within said housing engages one end of the said shackle not engaged by said shackle pin as said shackle is tilted in reference to its locked position in said housing, inserted into one of the two said lateral apertures and uprighted again.

5. The lock assembly in claim 4 wherein a minimally sized slot in the edge of either or both the overlapping portions of said access apertures in said collar and said housing in said first position that prevent access to said housings interior allow a link to exist between the key within a closed housing aperture and an object outside the entire lock assembly.

* * * * *